US006666329B1

(12) United States Patent
Charbonneau

(10) Patent No.: US 6,666,329 B1
(45) Date of Patent: Dec. 23, 2003

(54) COLLAPSIBLE CUP WITH VENTED POCKET

(75) Inventor: Joan Charbonneau, Basking Ridge, NJ (US)

(73) Assignee: Promotions Unlimited, Inc., Basking Ridge, NJ (US)

( * ) Notice: Subject to any disclaimer, the term of this patent is extended or adjusted under 35 U.S.C. 154(b) by 0 days.

(21) Appl. No.: 10/360,074

(22) Filed: Feb. 6, 2003

(51) Int. Cl.[7] ..... B65D 25/04

(52) U.S. Cl. ..... 206/218; D7/511; D7/512; 206/219; 206/538; 215/6; 220/8; 426/111

(58) Field of Search ..... D7/509, 511, 512; 206/38, 217, 218, 219, 538, 570; 215/6, 10, 386, 387, DIG. 3; 220/8; 426/86, 111; 604/78

(56) References Cited

U.S. PATENT DOCUMENTS

| | | | | | |
|---|---|---|---|---|---|
| 640,418 | A | | 1/1900 | Royer | |
| 1,040,652 | A | | 10/1912 | Douglas | |
| 1,093,873 | A | * | 4/1914 | Mitchell | 220/8 |
| 2,623,368 | A | | 12/1952 | Olsen | 65/13 |
| 2,919,694 | A | | 1/1960 | Von Gunten | 128/222 |
| 2,940,447 | A | | 6/1960 | Zanegood | 128/222 |
| 3,285,459 | A | | 11/1966 | Gahm | 220/8 |
| 3,331,369 | A | | 7/1967 | Keck | 128/222 |
| 3,434,589 | A | | 3/1969 | Valtri et al. | 206/46 |
| 3,810,470 | A | | 5/1974 | Von Gunten | 128/222 |
| 4,530,480 | A | | 7/1985 | Pratt | 248/311.2 |
| 4,940,138 | A | | 7/1990 | Hornstein | 206/218 |
| 4,978,021 | A | | 12/1990 | Mini et al. | 220/8 |
| 5,538,180 | A | | 7/1996 | Lo | 229/405 |
| 6,126,010 | A | | 10/2000 | Kogen | 206/570 |
| 2003/0024830 | A1 | | 2/2003 | Sharon | 2/219 |

* cited by examiner

*Primary Examiner*—Jim Foster
(74) *Attorney, Agent, or Firm*—Grant D. Kang; H. Frederick Rusche; Husch & Eppenberger LLC

(57) ABSTRACT

A collapsible cup with vented pocket comprises a base member for supporting the apparatus. A plurality of telescoping components form a fluid-tight seal by friction fitting the plurality of telescoping components together. An outermost telescoping component is attached to the base member to form an impervious junction between the base member and the outermost telescoping component. A vented pocket is attached to an innermost telescoping component. The innermost telescoping component is the final component of the plurality of telescoping components.

12 Claims, 4 Drawing Sheets

COLLAPSIBLE CUP WITH VENTED POCKET

CROSS-REFERENCE TO RELATED APPLICATIONS

None.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention relates generally to containers and, more particularly, to a collapsible cup with vented pocket and method of placing a pill into a collapsible cup with vented pocket.

Seasonal allergy sufferers and others who take a daily pill to remedy aches and pains have had a difficult time administering their medication. Because of this, it is desirous to find an easier way to dispense a pill.

2. Related Art

Solid cups having a pill-dispensing pocket are known. These cups, however, have a problem in that the "pocket" or pill-dispensing area, requires the pill to be placed in a certain orientation. In addition, only pills of a certain size can be deployed in the pill-dispensing area.

Collapsible cups are known in the camping arts.

SUMMARY OF THE INVENTION

It is in view of the above problems that the present invention was developed. Generally, collapsible cup with vented pocket comprises a base member for supporting the apparatus. A plurality of telescoping components form a fluid-tight seal by friction fitting the plurality of telescoping components together. An outermost telescoping component is attached to the base member to form an impervious junction between the base member and the outermost telescoping component. A vented pocket, alternately termed pill basket, or vented pill basket, is attached to an innermost telescoping component. The innermost telescoping component is the final component of the plurality of telescoping components.

The method of the present invention comprises the steps of first obtaining a pill. Second, the pill is placed into a collapsible cup with vented pocket. Finally, a plurality of telescoping components is actuated.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
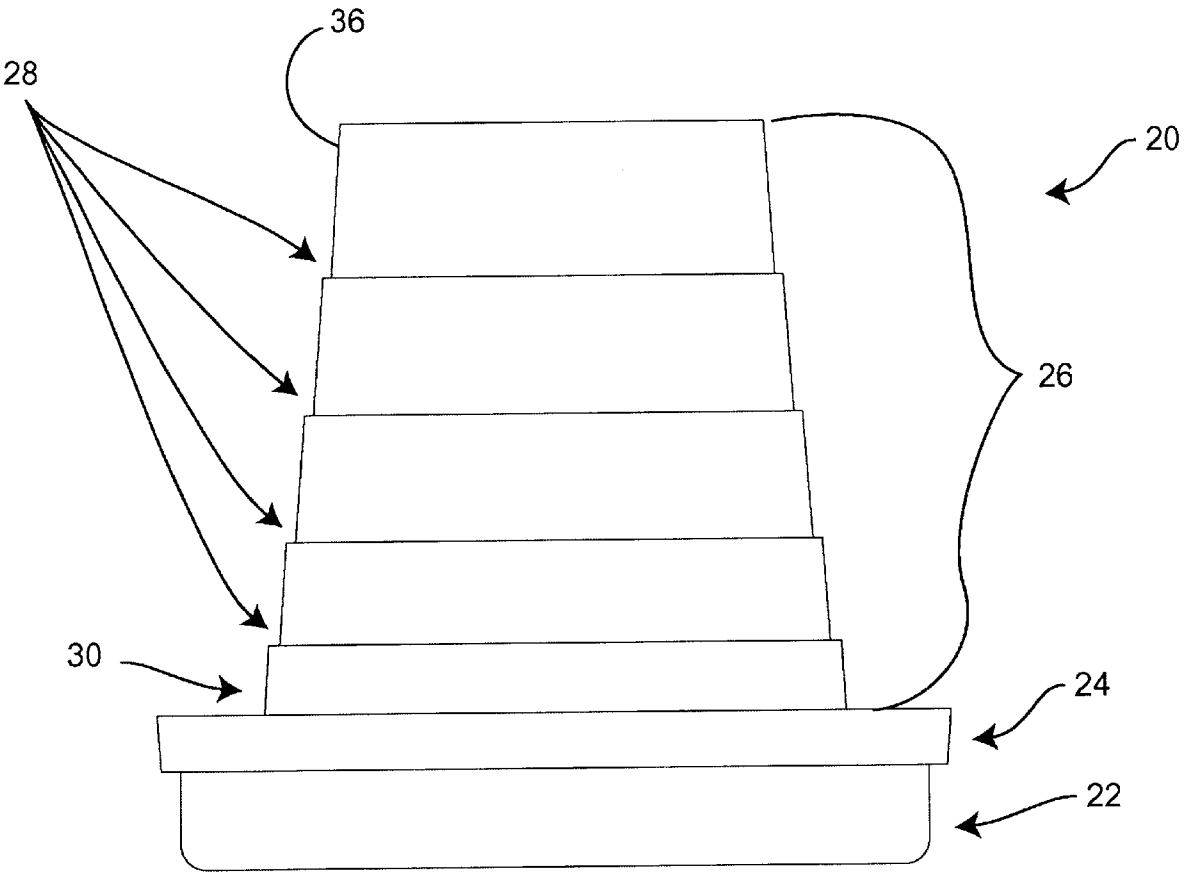
FIG. 1 is a side view of a typical collapsible cup with vented pocket, shown without a mating lid, with a plurality of telescoping components in expanded form.

Referring to the accompanying drawings in which like reference numbers indicate like elements, FIG. 1 illustrates a collapsible cup with vented pocket. Reference character 20 generally indicates the apparatus of the present invention. A base member 22 provides foundational support for the apparatus 20.

The base member 22 is cylindrical in shape. However, it is envisioned that the base member 22 may be any shape suitable to maintain the structural integrity of the apparatus 20.

The base member has a contoured lip 24 on its upper side, thus increasing the overall circumference of the base member 22 as one views the base member from bottom to top. The base member 22 supports a plurality of telescoping components 26. FIG. 1 shows that five components preferably comprise the plurality of telescoping components 26. It is preferred that each component comprising the plurality of telescoping components 26 be cylindrical in shape. It is, however, understood that component shape may be any geometrical shape allowing telescopic motion, such as square, triangular, or any host of other shapes. Likewise, it is also understood that the total number of components comprising the plurality of telescoping components 26 may deviate from five. This allows one to properly size the apparatus 20 for an appropriate fluid volume.

A fluid-tight seal 28 is formed by friction-fitting the plurality of telescoping components 26 together. This is possible because the plurality of telescoping components 26 are a series of progressively varying circumference either progressively-decreasing or progressively-increasing depending on the initial point of reference. Friction fitting allows proper liquid containment when using the apparatus 20. An outermost telescoping component 30 is attached to the base member 22 to form an impervious junction 32 between the base member 22 and the outermost telescoping component 30. The impervious junction 32 is necessary in order to allow proper liquid containment when using the apparatus.

Figure 2:
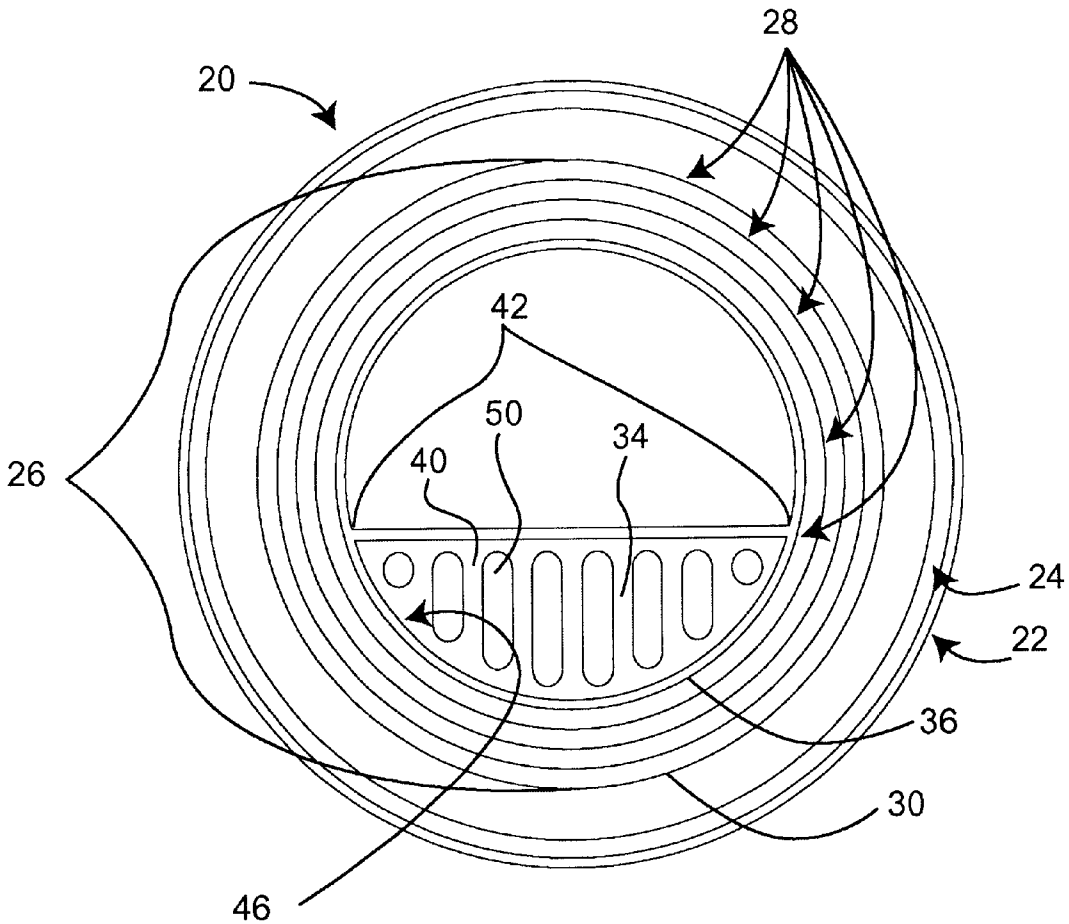
FIG. 2 is a top view of the collapsible cup with vented pocket shown without the mating lid.

As depicted in FIG. 2, a vented pocket 34 (alternatively termed a pill basket or vented pill basket) is attached to an innermost telescoping component 36. The innermost telescoping component 36 is the final component, or end piece of the plurality of telescoping components 26.

Figure 3:
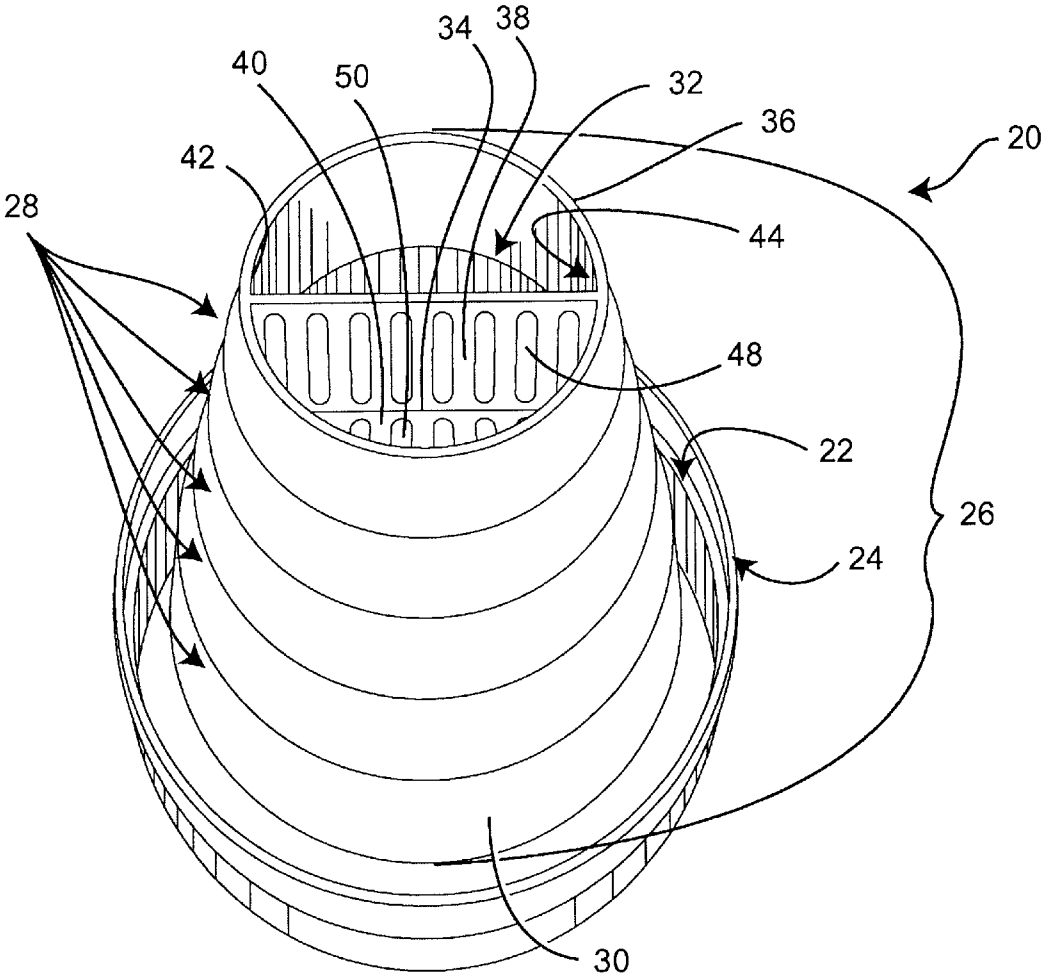
FIG. 3 is a perspective of the collapsible cup with vented pocket, shown without the mating lid, with a plurality of telescoping components in expanded form.

Referring simultaneously to FIGS. 2 and 3, the plurality of telescoping components 26 are a series of cylinders having decreasing circumference. This allows the plurality of telescoping components 26 to friction-fit together and form the fluid-tight seal 28. The outermost telescoping component 30 is molded to the base member 22 to form the impervious junction 32. It is envisioned that the impervious junction 32 may also be formed by an adhesive, weld, bond, or other suitable attachment means.

The vented pocket 34 is formed by attaching a rectangular plate 38 perpendicularly with a semi-circular plate 40. The attachment of the rectangular plate 38 to the semicircular plate 40 may be by any suitable method, including, but not limited to, molding, welding, or adhesion. Narrow edges 42 of the rectangular plate 38 are molded into an inside edge 44 of the innermost telescoping component 36. A curved edge 46 of the semi-circular plate 40 is also molded into the inside edge 44 of the innermost telescoping component 36. Likewise, the attachment of the narrow edges 42 of the rectangular plate 38 and the curved edge 46 of the semi-circular plate 40 may be performed by any suitable method, such as molding, welding, or adhesion.

The vented pocket 34 allows liquid transmission to occur. This is possible because both the rectangular plate 38 and the semi-circular plate 40 are perforated. Rectangular plate perforations 48, as shown, are narrow rectangular incisions through the rectangular plate 38. Upper ends of the rectangular plate perforations 48 are rounded. Semi-circular plate perforations are both circular and oval in shape. It is, however, understood that on both the rectangular plate 38 and the semi-circular plate 40, the perforations may be any shape that permits liquid (such as water, cola, or juice) to flow therethrough.

Using the apparatus 20 involves obtaining a pill from a store, one's pants pocket, medicine cabinet, or other appropriate place, and placing the pill into the vented pocket 34. The plurality of telescoping components 26 would then be actuated by hand. A person would grasp the rectangular plate 38 with the fingers of one hand and place his other hand on the base member 22. The person would then pull the rectangular plate 38 up, thus extending the plurality of telescoping components 26, while maintaining pressure on the base member 22 with his other hand. It is, however, understood that placement of the pill into the vented pocket 34 may also be automated, such as in a factory assembly line employing programmable logic controllers or other automated processes. Likewise, in similar fashion, actuation of the plurality of telescoping components 26 may also be automated.

Figure 4:
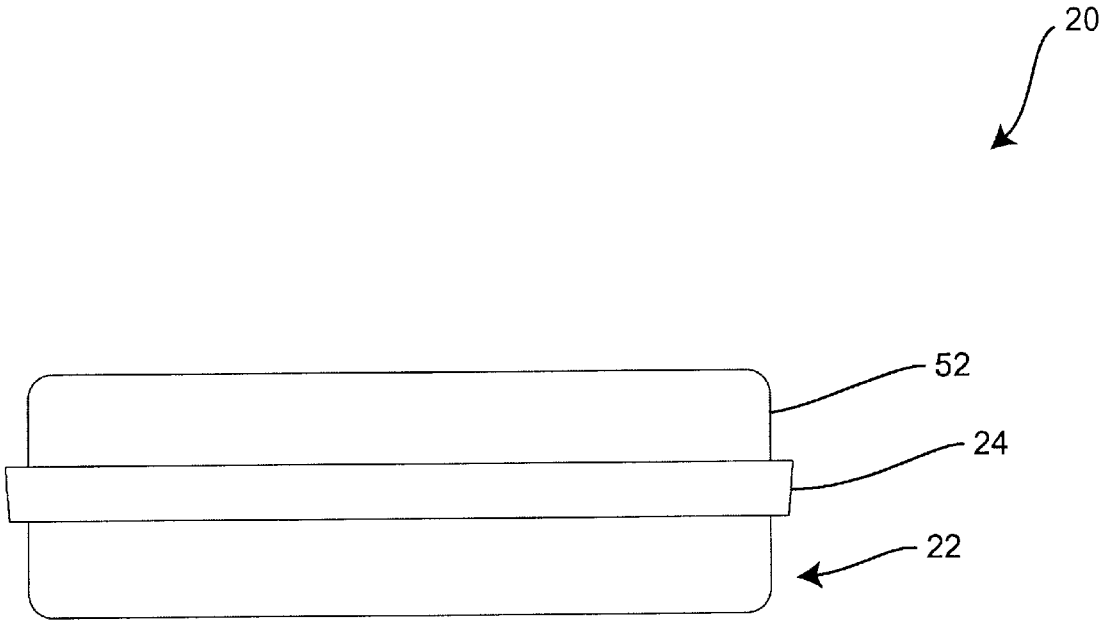
FIG. 4 is a side view of the collapsible cup with vented pocket, shown with the plurality of telescoping components in retracted form, with the mating lid included.

Retracting the apparatus 20 involves pushing down on the rectangular plate 38 or innermost telescoping component 36 until the plurality of telescoping components 26 are in their retracted position. As shown in FIG. 4, the base member has a mating lid 52 that covers the apparatus 20 when the plurality of telescoping components 26 are in their retracted position. The mating lid 52 fits snugly over the apparatus 20 by sliding on top of the apparatus until movement is stopped by the contoured lip 24. The mating lid 52 allows one to encapsulate the pill in the apparatus 20 and to make the apparatus smaller and more mobile. It is envisioned that one may transport the apparatus 20 in one's pocket, brief case, or similar carrying location, once the plurality of telescoping components 26 are in their retracted position and the mating lid 52 is placed over the apparatus.

In view of the foregoing, it will be seen that the several advantages of the invention are achieved and attained.

The embodiments were chosen and described in order to best explain the principles of this invention and its practical application to thereby enable others skilled in the art to best utilize the invention in various embodiments and with modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A collapsible cup with vented pocket comprising:

a base member;

a plurality of telescoping components each extending completely around a partial volume of said cup, with said plurality of telescoping components adapted to form a substantially liquid-tight seal upon telescopic extension by friction-fitting said plurality of telescoping components together, with one of said plurality of telescoping components being attached to said base member to form an impervious junction between said base member and said one of said plurality of telescoping components; and a vented pocket fixedly attached to another of said plurality of telescoping components.

2. A collapsible cup with vented pocket according to claim 1, further consisting essentially of:

a mating lid that covers only the circumference of said collapsible cup with vented pocket when said plurality of telescoping components are in a retracted position.

3. A collapsible cup with vented pocket according to claim 1 wherein said plurality of telescoping components are a series of cylinders having progressively varying circumference.

4. A collapsible cup with vented pocket according to claim 3 wherein said outermost telescoping component is fixed to said base member to form a substantially liquid-tight junction between said base member and said outermost telescoping component.

5. A collapsible cup with vented pocket according to claim 1 wherein said vented pocket comprises:

a rectangular plate;

a semi-circular plate attached perpendicularly to said rectangular plate;

wherein edges of said rectangular plate and a curved edge of said semi-circular plate are attached to an inside edge of said another of said plurality of telescoping components.

6. A collapsible cup with vented pocket according to claim 5 wherein said rectangular plate is perforated to allow liquid transmission.

7. A collapsible cup with vented pocket according to claim 6 wherein said semi-circular plate is perforated to allow liquid transmission.

8. A collapsible cup with vented pocket comprising:

a base member;

a plurality of telescoping components, with said plurality of telescoping components adapted to form a substantially liquid-tight seal upon telescopic extension by friction-fitting said plurality of telescoping components together, with one of said plurality of telescoping components being attached to said base member To form an impervious junction between said base member and said one of said plurality of telescoping components; and a vented pocket attached to another of said plurality of telescoping components and including:

a rectangular plate;

a semi-circular plate attached perpendicularly to said rectangular plate;

wherein edges of said rectangular plate and a curved edge of said semi-circular plate are attached to an inside edge of said another of said plurality of telescoping components.

9. A collapsible cup with vented pocket comprising:

a base member;

a plurality of telescoping components, with said plurality of telescoping components adapted to form a substantially liquid-tight seal upon telescopic extension by friction-fitting said plurality of telescoping components together, with one of said plurality of telescoping components being attached to said base member to form an impervious junction between said base member and said one of said plurality of telescoping components, the construction of said telescoping components providing an increased substantially liquid-tight volume when said cup is telescopically extended; and a vented pocket fixedly attached to another of said plurality of telescoping components.

10. A collapsible cup with vented pocket according to claim 9, further consisting essentially of:

a mating lid that covers only the circumference of said collapsible cup with vented pocket when said plurality of telescoping components are in a retracted position.

11. A collapsible cup with vented pocket according to claim 9 wherein said plurality of telescoping components are a series of cylinders having progressively varying circumference.

12. A collapsible cup with vented pocket according to claim 11 wherein said outermost telescoping component is fixed to said base member to form a substantially liquid-tight junction between said base member and said outermost telescoping component.

* * * * *